US010400539B2

(12) United States Patent
Wise et al.

(10) Patent No.: US 10,400,539 B2
(45) Date of Patent: Sep. 3, 2019

(54) FLOW BACK RETRIEVAL METHOD FOR BOREHOLE PLUG WITH A LOWER SLIP ASSEMBLY THROUGH TUBULARS OF DIFFERENT SIZES

(71) Applicant: BAKER HUGHES, A GE COMPANY, LLC, Houston, TX (US)

(72) Inventors: Tristan R. Wise, Spring, TX (US); Zachary S. Silva, Houston, TX (US); Elias Pena, Katy, TX (US); Hector O. Gonzalez, Humble, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 161 days.

(21) Appl. No.: 15/635,371

(22) Filed: Jun. 28, 2017

(65) Prior Publication Data

US 2018/0023363 A1 Jan. 25, 2018

Related U.S. Application Data

(63) Continuation-in-part of application No. 15/605,716, filed on May 25, 2017, and a continuation-in-part of (Continued)

(51) Int. Cl.
*E21B 33/12* (2006.01)
*E21B 33/128* (2006.01)

(Continued)

(52) U.S. Cl.
CPC ..... *E21B 33/12* (2013.01); *E21B 23/04* (2013.01); *E21B 23/06* (2013.01); *E21B 33/128* (2013.01); *E21B 33/129* (2013.01); *E21B 33/1293* (2013.01); *E21B 33/16* (2013.01); *E21B 34/10* (2013.01); *E21B 37/10* (2013.01); *E21B 33/14* (2013.01); *E21B 37/00* (2013.01); *E21B 43/20* (2013.01); *E21B 43/24* (2013.01);

(Continued)

(58) Field of Classification Search
CPC ..... E21B 33/1291; E21B 23/01; E21B 23/04
See application file for complete search history.

(56) References Cited

U.S. PATENT DOCUMENTS 6,167,963 B1 1/2001 McMahan et al.
6,250,383 B1 6/2001 Patel (Continued)

FOREIGN PATENT DOCUMENTS

WO 200806891 A3 5/2008

*Primary Examiner* — Brad Harcourt
(74) *Attorney, Agent, or Firm* — Shawn Hunter

(57) ABSTRACT

A borehole plug or packer for treating is designed to be flowed back to a surface location after use. When the treatment is concluded pressure from above is relieved or lowered, and well fluid is flowed back, so that the plug or plugs disengages at slips designed to resist differential pressure from above. The application of differential pressure from below causes the lower slips to release one or more of such plugs in the hole into specialized sub surface or surface capture equipment so that well pressure is relieved before removal of the plugs from specialized subsurface or surface capture equipment. At least one apparatus is used to bridge transitions in wellbore dimension on the way to the surface and close the gaps to allow produced formation fluid to continue taking a packer or plug past the well diameter transition.

21 Claims, 5 Drawing Sheets

Related U.S. Application Data application No. 15/168,658, filed on May 31, 2016, now abandoned.

(51) Int. Cl.

| | |
|---|---|
| ***E21B 33/129*** | (2006.01) |
| ***E21B 34/10*** | (2006.01) |
| ***E21B 37/10*** | (2006.01) |
| ***E21B 23/04*** | (2006.01) |
| ***E21B 23/06*** | (2006.01) |
| ***E21B 33/16*** | (2006.01) |
| *E21B 34/00* | (2006.01) |
| *E21B 43/26* | (2006.01) |
| *E21B 43/20* | (2006.01) |
| *E21B 43/25* | (2006.01) |
| *E21B 37/00* | (2006.01) |
| *E21B 43/24* | (2006.01) |
| *E21B 33/14* | (2006.01) |

(52) U.S. Cl.

CPC ..... *E21B 43/25* (2013.01); *E21B 43/26* (2013.01); *E21B 2034/007* (2013.01)

(56) References Cited

U.S. PATENT DOCUMENTS

| | | | | |
|---|---|---|---|---|
| 6,755,244 | B1 | 6/2004 | Koopmans | |
| 7,036,602 | B2 | 5/2006 | Turley et al. | |
| 7,080,693 | B2 | 7/2006 | Walker et al. | |
| 7,389,823 | B2 | 6/2008 | Turley et al. | |
| 7,861,781 | B2 | 1/2011 | D'Arcy | |
| 8,002,030 | B2 | 8/2011 | Turley et al. | |
| 8,127,846 | B2 | 3/2012 | Hill et al. | |
| 8,191,633 | B2 | 6/2012 | Frazier | |
| 8,240,390 | B2 | 8/2012 | Hendrickson et al. | |
| 9,080,422 | B2 | 7/2015 | Melenyzer | |
| 2010/0206580 | A1* | 8/2010 | Tessari ..... | E21B 10/64 166/377 |
| 2014/0190685 | A1 | 7/2014 | Frazier et al. | |

* cited by examiner

FLOW BACK RETRIEVAL METHOD FOR BOREHOLE PLUG WITH A LOWER SLIP ASSEMBLY THROUGH TUBULARS OF DIFFERENT SIZES

PRIORITY INFORMATION

This application is a continuation-in-part of U.S. patent application Ser. No. 15/605,716 filed on May 25, 2017, and a continuation-in-part of U.S. patent application Ser. No. 15/168,658 filed on May 31, 2016

FIELD OF THE INVENTION

The field of the invention is borehole barriers and more particularly designs that see pressure from above and are retrieved to a surface or subsurface location by lowering pressure from above and flowing uphole through or below the plug above an established flow rate with the aid of an apparatus that bridges a gap to the surrounding tubular wall as the tubular increases in dimension toward a surface location.

BACKGROUND OF THE INVENTION

Borehole plugs are used in a variety of applications for zone isolation. In some applications the differential pressure experienced in the set position can come from opposed directions. These plug typically have a sealing element with mirror image slips above and below the sealing element. The plug is set with a setting tool that creates relative movement between a setting sleeve that is outside the mandrel and the plug mandrel. The slips have wickers oriented in opposed directions and ride out on cones to the surrounding tubular. The sealing element is axially compressed after the first set of slips bite followed by setting of the other set of slips on the opposite side of the sealing element from the first slip set to set. The set position of these elements is maintained by a body lock ring assembly. Body lock ring assemblies are in essence a ratchet device that allows relative movement in one direction and prevents relative movement in the opposite direction. The relative movement that compresses the sealing element and drives the opposed slips out on respective cones is locked by a body lock ring. Body lock rings are threaded inside and out and sit between two relatively movable components. The thread forms are such that ratcheting in one direction only is enabled. A good view of such a design is shown in FIG. 13 of U.S. Pat. No. 7,080,693. The trouble with such a design in applications where the plug needs to be quickly milled out after use such as in treating or fracturing is that the shear loading on the ratcheting patterns is so high that the ratchet teeth break at loads that are well within the needed operating pressure range for the plug. With fracturing pressures going up and the use of readily milled components such as composites a new approach to locking was needed. The goal during treating is to hold the differential pressure from above while keeping the design simple so as not to prolong the milling time for ultimate removal. A typical zone treatment can involve multiple plugs that need to be removed. Elimination of upper slips when using the lock ring of the present invention also shortens milling time. Better yet, milling of the plugs can be avoided by lowering pressure from above to induce flow back from the stage below the targeted plug, until the slips of the plug or series of plugs to disengage and come up to a surface location such as into specialized surface or subsurface equipment where the pressure can be relieved and the plug or plugs safely removed. In some situations the casing or tubular string gets larger as it gets closer to the surface and if the plug or plugs are being flowed to the surface they can slow down or fail to finish the travel to be captured either below or above the wellhead due to a loss of contact with the borehole walls resulting in loss of upward force. In those situations at least one apparatus is used to facilitate not only pumping the plug into position but to also aid the movement of the plug back uphole in wells where the string size increases on the way toward the surface.

The lock ring is preferably split to ease its movement when axial opposed forces are applied to set the plug. The ring is tapered in cross section to allow it to act as a wedge against reaction force tending to relax the components from the set position. The side of the ring facing the mandrel has a surface treatment that provides minimal resistance in the setting direction and digs into the mandrel to resist reaction forces from the compressed sealing element in the set position. Preferably the surface treatment is a series of extending members oriented downhole with sharp ends that can dig into the mandrel for a firm grip. These and other aspects of the present invention can be better understood by those skilled in the art from a review of the description of the preferred embodiment and the associated drawings while recognizing that the full scope of the invention is to be determined from the appended claims.

Multicomponent body lock rings have been made of easily milled materials such as composites as illustrated in US 2014/0190685; U.S. Pat. Nos. 8,191,633; 6,167,963; 7,036,602; 8,002,030 and 7,389,823. The present invention presents a way to avoid milling altogether so that the use of composites that aid milling become an optional feature. This can reduce the cost of each plug in treatments that frequently involve multiple plugs. U.S. Pat. No. 8,240,390 is relevant to packer releasing methods. Wiper plugs typically used in cementing operations are well known and described in the following references: U.S. Pat. Nos. 9,080,422; 7,861,781 and 8,127,846. These plugs typically stay downhole and none are used to aid in plug recovery to the surface using formation pressure.

SUMMARY OF THE INVENTION

A borehole plug or packer for treating is designed to be flowed back to a subsurface or surface location after use. The plug handles differential pressure from above using a lower slip assembly under a sealing element. A setting tool creates relative axial movement of a setting sleeve and a plug mandrel to compress the seal against the surrounding tubular and set the slips moving up a cone against the surrounding tubular to define the set position for the plug. The set position is held by a split lock ring having a wedge or triangular sectional shape and a surface treatment facing the mandrel that slides along the mandrel during setting movement but resists opposed reaction force from the compressed sealing element. The surface treatment can be a series of downhole oriented ridges such as a buttress thread that preferably penetrate the mandrel when holding the set position. When the treatment is concluded pressure from above is relieved or lowered so that the plug or plugs disengage at slips designed to resist differential pressure from above. The application of flow from below causes the slips to release one or more of such plugs in the hole in order to flow uphole into specialized surface or subsurface equipment so that well pressure is relieved before removal of the plugs from the well. To aid the plugs on the way up the borehole in situations where the tubular size increases on the way out of the borehole an apparatus is employed that can enlarge to bridge a growing gap on the way out of the borehole so that the plug velocity with formation pressure can continue to move the flowed plug back to capture equipment above or below the wellhead.

DETAILED DESCRIPTION OF THE PREFERRED EMBODIMENT

Figure 1:
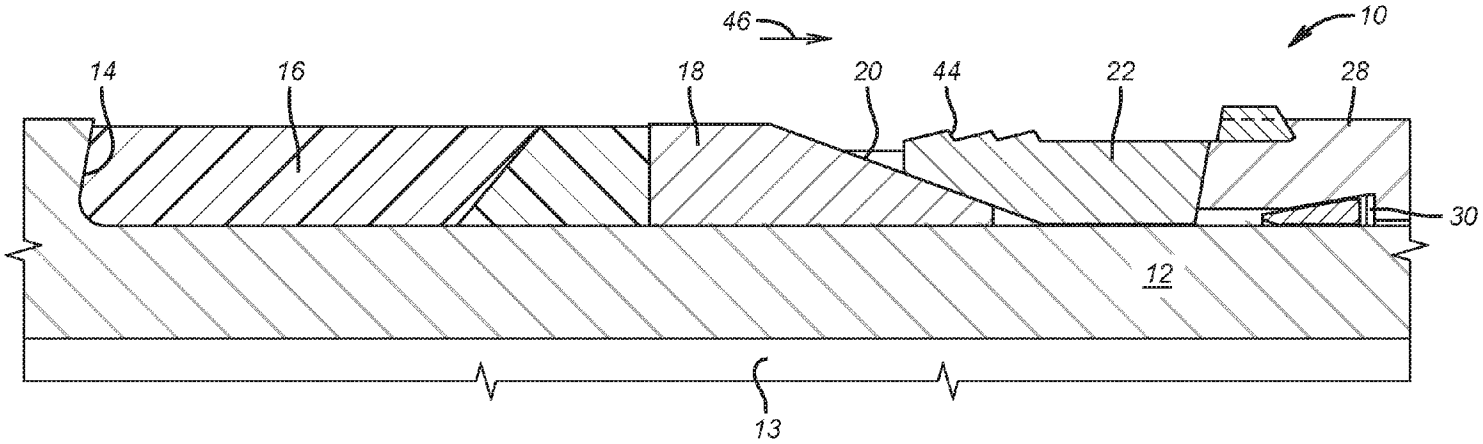
FIG. 1 is a section view of the plug in the run in position.
Figure 2:
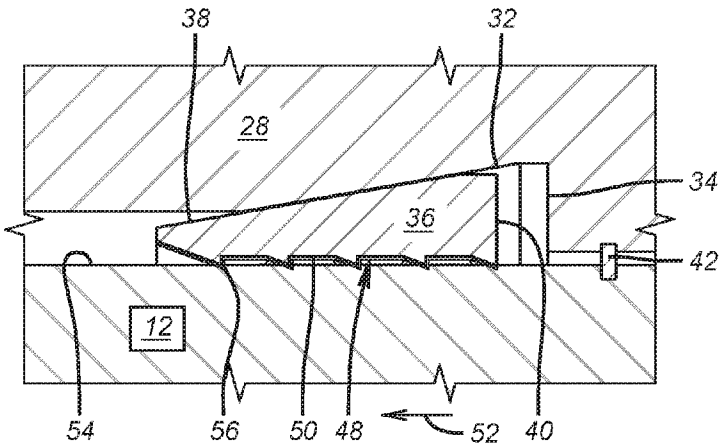
FIG. 2 is a close up view of the lock ring shown in FIG. 1.
Figure 3:
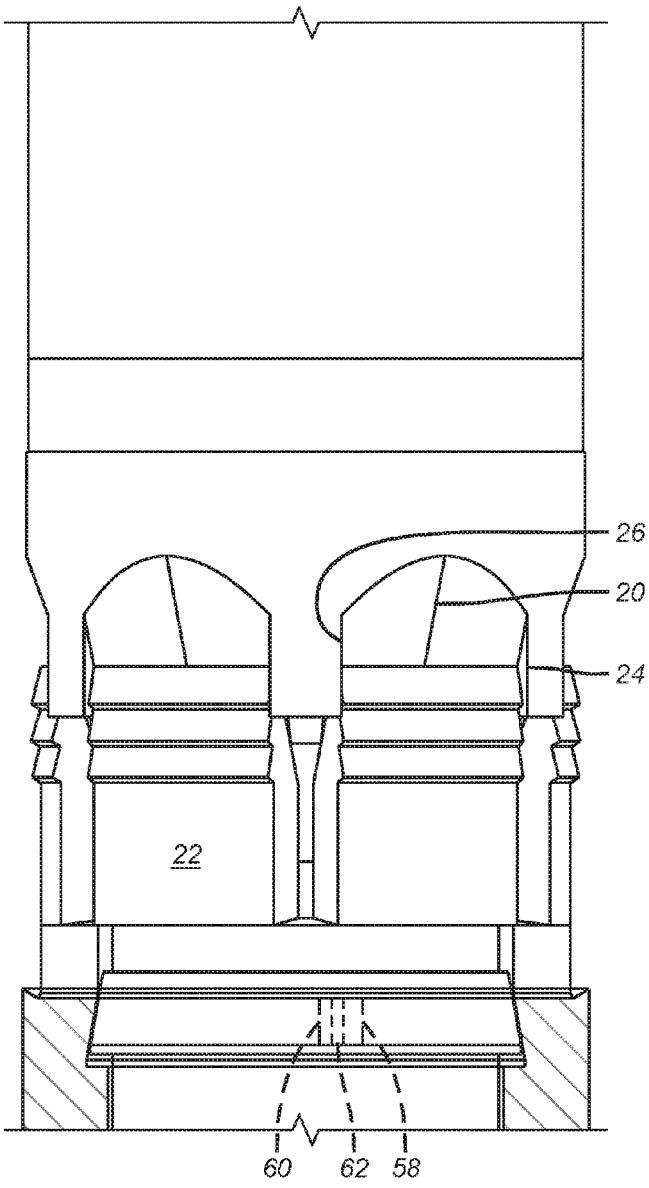
FIG. 3 is an exterior view of the plug.

Referring to FIG. 1 the plug or packer 10 has a mandrel 12 preferably made of a readily milled material such as a composite. Mandrel 12 can optionally have a passage 13 that can be optionally closed with a ball landed on a seat or with a valve (not shown). Shoulder 14 supports sealing element 16. A cone 18 has individualized tapered surfaces 20 on which a slip, drag block or other retainer collectively referred to as slip 22 is guided between opposed surfaces 24 and 26. The slips 22 are each connected to a slip ring 28 that has a triangular undercut 30 when viewed in section in FIG. 1 that extends for 360 degrees, preferably. The undercut is defined by surfaces 32 and 34 as better seen in FIG. 2. The undercut 30 and lock ring 36 may be inverted from the FIG. 2 position in which case the ribs 56 will be oriented uphole to resist differential pressure in an uphole direction. Lock ring 36 has an outer surface 38 that is preferably parallel to surface 32 of undercut 30. Bottom surface 40 of ring 36 is contacted by surface 34 of undercut 30 during the setting process. A shear pin or some other breakable member 42 allows the sealing element 16 to be compressed against a surrounding tubular that is not shown before the slips 22 are released to move up ramp surfaces 20 by the breaking of the shear pin 42. Movement of ring 28 relative to mandrel 12 brings together surfaces 34 and 40 to push the lock ring 36 in tandem with ring 28 during setting with a setting tool that is well known and is not shown and which serves as the force to brace the mandrel 12 while applying compressive force to the sealing element 16 and then extending the slips 22 against the surrounding tubular. The slips 22 have a surface treatment such as wickers 44 that resist reaction force from the compressed sealing element 16 as well as applied pressure loads from uphole applied in the direction of arrow 46. Because the wickers 44 are designed to hold pressure differential from above they are oriented downhole so that when the flow back rate is significantly increased the wickers 44 will disengage from the surrounding borehole wall, usually a tubular and the plug 10 will come loose. If there is a ball landed on a seat in the plug it may lift off and come uphole or lift and come uphole to seat on the next borehole plug. The flow through the plug will be sufficient to propel that plug into the plug above it, if any, and then further up the hole into specialized surface or subsurface equipment for isolation and depressurization so that the plug or plugs can be removed.

The lock ring 36 has a surface treatment 48 on bottom surface 50 that faces the mandrel 12. During setting when the ring 28 takes lock ring 36 with it the surface treatment 48 rides along surface 54 of mandrel 12 without penetration of surface 54. However, after the set and release from the plug by the setting tool the reaction force from the sealing element 16 causes the downhole oriented ribs 56 to penetrate the surface of the mandrel 12 to brace the lock ring 36 so that it can act as a wedge using surface 38 to prevent motion of ring 28 in the direction of arrow 46.

Lock ring 36 can run continuously for nearly 360 with a single split to facilitate assembly to the mandrel 12. Alternatively, there can be discrete spaced segments for the majority of the 360 degree extent of the undercut 30. Undercut 30 can be continuous or discontinuous for 360 degrees to retain lock ring 36 when lock ring 36 is formed of discrete segments. The wedging action between surfaces 32 and 38 reduces the stress in an axial direction parallel to surface 54 to discourage shear failure of the ribs 56 while the preferred composite construction of the mandrel 12 encourages penetration through surface 54. The wedging action creates a radial and axial component forces to the ribs 56 to increase the penetration into the mandrel 12 and to decrease the axial shear force component acting on the ribs 56 at the outer surface of said mandrel 12. The ribs 56 can be parallel or one or more spiral patterns or a thread form such as a buttress thread. The rib spacing can be equal or variable. The lock ring 36 can preferably be made of composite material or a soft metallic that can be easily drilled. Optionally, if lock ring 36 is a continuous split ring the faces 58 and 60 that define the split can be placed on opposed sides of a tab 62 on mandrel 12 to rotationally lock the two together to prevent lock ring relative rotation with respect to the mandrel 12 when milling out. When segments are used for the lock ring 36 each segment can be rotationally retained in a dedicated undercut 30 in ring 28 to rotationally secure the components when milling out. Alternatively, some or all of the above described plug 10 apart from sealing element 16 can be made of a disintegrating controlled electrolytic material to forgo the milling out altogether.

Optionally the ribs 56 can be omitted so that bottom surface 50 can make frictional contact with surface 54 with no or minimal penetration so that the retaining force is principally or entirely a frictional contact. Surface 50 can have surface roughening or it can even be smooth. While the ability to hold reaction force may be somewhat decreased without the ribs 50 there is still enough resistance to reaction force to hold the set position for some applications. Wedging action creates the frictional retention force.

Figure 4:
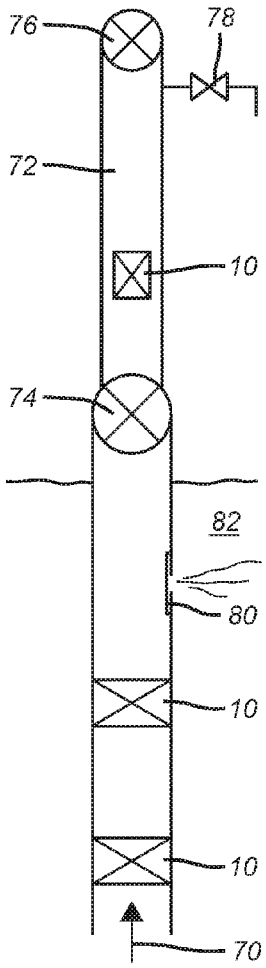
FIG. 4 is a schematic view of recovery of packers or plugs with net differential pressure.

FIG. 4 shows packers 10 still in position and others already displaced by a new uphole force shown schematically as arrow 70. This condition is normally accomplished by reducing pressure above the set packers 10 from a surface location. When a net uphole force is developed against any of the packers 10 the wickers at some level of net uphole force will no longer be able to retain the grip to the surrounding tubular and the packer 10 will move uphole. It wall pass lower valve 74 of surface or subsurface capture equipment 72 and will be stopped by the upper valve 76. Once one or more of the packers 10 are in the specialized surface or subsurface capture equipment 72, the bottom valve 74 is closed and a vent valve 78 is opened and the packers are removed out the top of the specialized surface or subsurface capture equipment 72 through valve 76. Milling is only needed if one of the packers 10 fails to come to the surface under a net uphole flow from the formation schematically represented by arrow 70. The specialized surface or subsurface capture equipment 72 can also feature a counter to give a local signal of how many packers 10 have passed into the specialized surface or subsurface capture equipment 72. As previously stated the orientation of wickers 44 in a downhole direction allows them to function to hold the set of each packer 10 with a net force applied from uphole in a downhole direction such as when performing a treatment. Care must be taken to keep a constant net force in a downhole direction to keep the packer or packers 10 in position. When the treatment ends for the zone the surface pressure is reduced and the grip of the wickers 44 is overcome. The wickers need no radial retraction, they simply give up their grip in the uphole direction as wickers 44 are not oriented to dig in in the uphole direction. This makes the design suitable for treatment where the net pressure is in a downhole direction and later retrieval where the net force on the packer is reversed in direction to bring the packer or packers to the surface. With that the sealing element 16 cannot hold the packer 10 in position and the motion starts uphole into the specialized surface or subsurface capture equipment 72. The one way oriented wickers 44 allow fixation under a net downhole pressure and retrieval under a net uphole flow. If the packers 10 have a landed object on a seat that closes a passage through the mandrel of a packer 10 it is possible for the object to lift off the seat and then flow through the packer 10 passage as well as the net uphole flow on the mandrel will bring that packer uphole. Bringing up one or more packers can also wipe the borehole of proppant or other solids that may have accumulated in the borehole. Optionally if the borehole has sliding sleeves for zone access, the recovery of the packers 10 with flow from below can also act to close sliding sleeves on the way out of the borehole. One such sliding sleeve 80 is shown adjacent treated formation 82 although multiple such sliding sleeves can be used and operated to close or to open by the passing packers 10 depending on the application.

Figure 5:
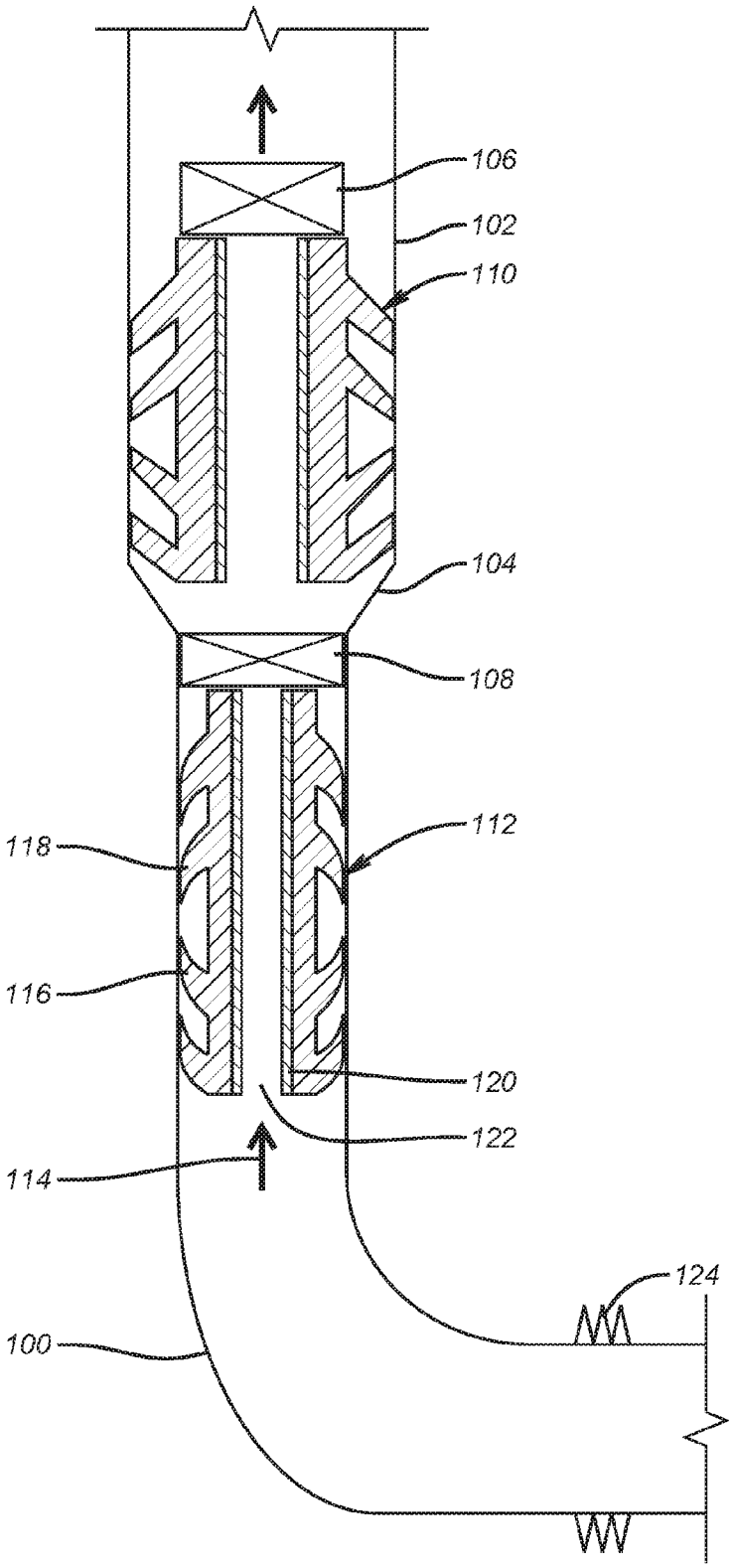
FIG. 5 illustrates the use of wipers to bring up plugs where the tubular size increases up the hole.
Figure 6:
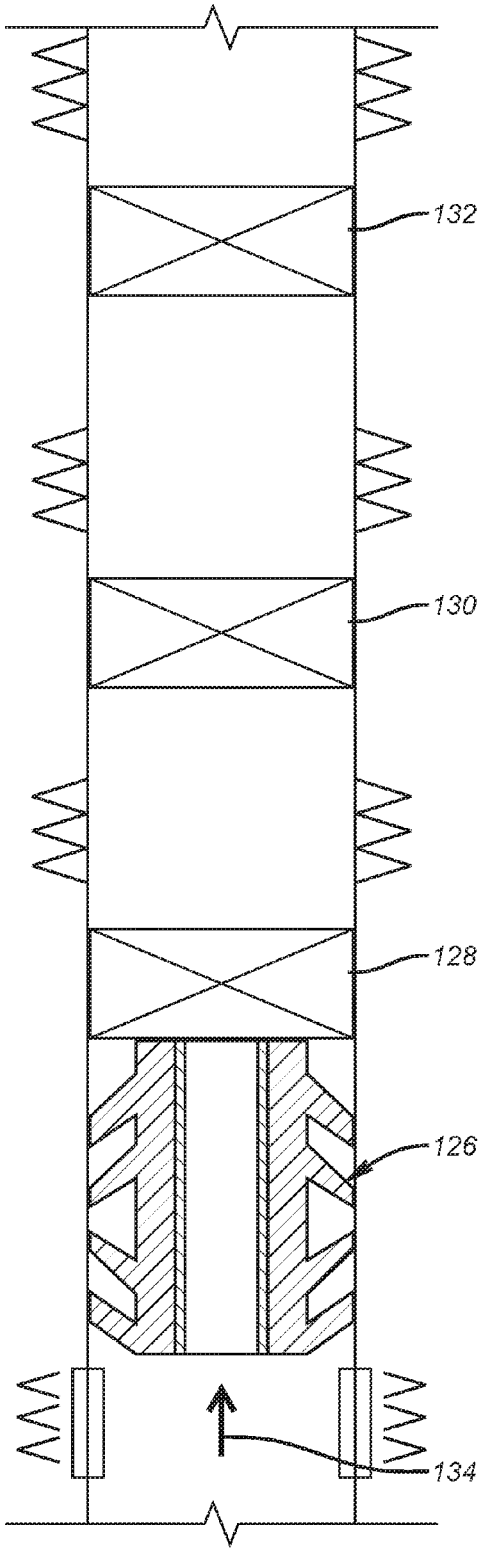
FIG. 6 illustrates the use of a single wiper to move multiple plugs up the hole.

FIG. 5 illustrates a horizontal borehole 100 that has a smaller dimension than an upper section 102 with a transition 104 in between. Section 100 can be a liner with a top at transition 104 and the upper section can be casing. Two plugs 106 and 108 are illustrated although more can be used. The plug 106 is backed by wiper 110 and the plug 108 is backed by wiper 112. Arrow 114 represents a net uphole force on the plugs 106 and 108 sufficient to dislodge their grip to the horizontal borehole after a treatment such as fracturing for example. This condition is typically accomplished by lowering the pressure above the plugs 106 and 108 such as by lowering the pressure above them from the surface for one example. The wipers 110 and 112 move with their respected plugs 106 and 108 out of section 100 and past transition 104 into casing 102. As that happens the fins 116 oriented uphole and the fins 118 oriented downhole flex to a relaxed position as shown for wiper 110 that has passed the transition 104. The wipers 110 and 112 each have a mandrel 120 with an open passage 122. The lowermost wiper is preferably positioned uphole from tow perforations 124. The wipers 110 and 112 can be delivered with their associated plug so that for example wiper 112 is delivered with plug 108 on a variety of conveyances such as coiled tubing, wireline or slickline. As an alternative to the arrangement in FIG. 6 a single wiper or multiple stacked wipers 126 can be delivered first ahead of plugs 128, 130 and 132 as shown in FIG. 6 so that a net uphole force represented by arrow 134 can bring up the wiper or wipers 126 with all the plugs above such as 128, 130 and 132 although a greater or lesser number of plugs can be retrieved in this manner. The opposed orientation of fins 116 and 118 allows pumping the associated wiper into the hole as well as recovering the associated wiper with a net uphole force from the formation with there being at least some fins in either direction of movement that engage the surrounding borehole wall to aid in the movement of the wiper in question. Note that sealing against the borehole walls of various dimensions on the way up the hole is not critical as long as flow is deterred sufficiently to allow the wiper in question to take up the hole however many plugs are used and that need recovery without a need to drill them out.

Figure 7:
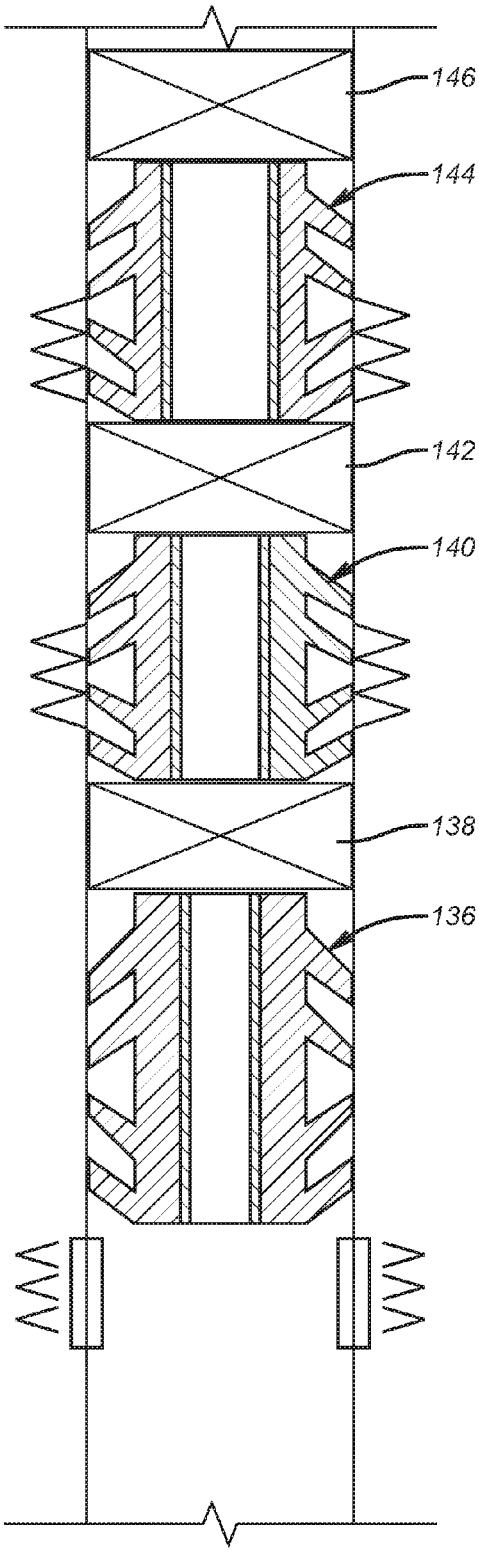
FIG. 7 illustrates using a dedicated wiper for each plug to bring the plugs up the hole.

Accordingly, as in FIG. 7 a wiper 136 can be associated with a plug 138. A wiper 140 can be associated with plug 142 and a wiper 144 can be associated with plug 146. Typically the plugs illustrated in FIG. 7 are identical and can be of the type that receive same sized balls in an uphole direction to close off a passage through them or depending on the treatment they can be straight plugs with no passage through them. Either way whether one wiper per plug is used or one wiper for a plurality of plugs, the goal is to be bring the plugs with the wiper or wipers to a capturing device above or below the wellhead as previously described.

Figure 8:
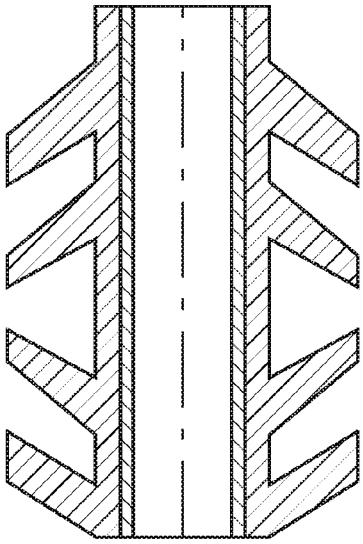
FIG. 8 shows a wiper fin design with fins oriented in opposed directions.
Figure 9:
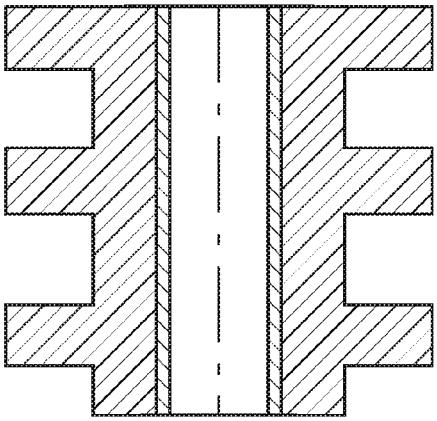
FIG. 9 is the view of FIG. 8 with the fins in a parallel orientation.
Figure 10:
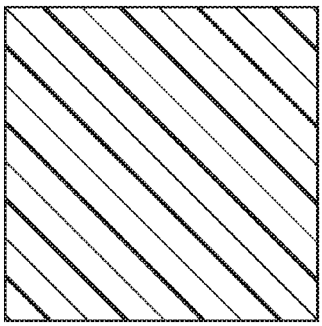
FIG. 10 is a section view of a wiper peripheral member with a quadrilateral section shape.
Figure 11:
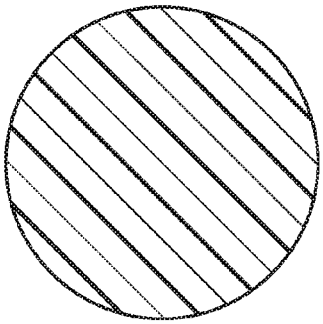
FIG. 11 is a section view of a wiper peripheral member with a circular section shape.

FIGS. 8-11 illustrate some alternative wiper designs. FIG. 8 has been previously described and FIG. 9 varies in that the fins, typically made of a resilient material such as rubber are extending radially perpendicular to the mandrel of the illustrated wiper. The wiper design can simply be a ring around a mandrel that may have a passage through the mandrel. The ring can have a quadrilateral shape as shown in FIG. 10 or a round shape as shown in FIG. 11 or triangular to name a few options. The ring may be flexible foam or some other material that can compress without undue resistance when going into a smaller dimension in the borehole and have some shape memory to expand on the way up the hole as the size of the hole increases one or more times. The rings need not be continuous because, as stated before, enough resistance to flow around the wiper is needed to keep the plug or plugs moving uphole at a reasonable speed.

Typically the well is allowed to come in by opening a valve or valves at the surface to release the plugs so that the plugs with the associated wiper or wipers can come up the hole. The plugs may engage each other on the way up the hole after they are broken loose and start the trip up the hole. As long as there is a perforation for formation access below the lowest wiper, all the plugs and wiper(s) should come up to the capture device as the path of least resistance is toward the surface.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

The above description is illustrative of the preferred embodiment and many modifications may be made by those skilled in the art without departing from the invention whose scope is to be determined from the literal and equivalent scope of the claims below:

We claim:

1. A method for retrieving at least one packer or plug from a borehole to a surface location, comprising:

creating a differential pressure on the set at least one packer or plug in an uphole direction toward the surface;

overcoming slip grip on said at least one packer or plug;

providing a mandrel on at least one wiper surrounded by a resilient ring that compresses when the borehole dimension decreases in the direction of travel and retains memory to expand toward a larger dimension when the borehole dimension increases in the direction of travel; and moving said at least one packer or plug toward the surface for capture with said at least one wiper.

2. The method of claim 1, comprising:

providing a peripheral flexible feature on said at least one wiper that changes dimension as said wiper passes through a change in dimension of the surrounding borehole.

3. The method of claim 1, comprising:

providing a plurality of packers or plugs as said at least one packer or plug;

moving said packers or plug with said at least one wiper located further downhole than said packers or plugs.

4. The method of claim 3, comprising:

providing a counting device to indicate how many packers or plugs have been flowed back toward the surface.

5. The method of claim 1, comprising:

providing a plurality of packers or plugs as said at least one packer or plug;

providing multiple wipers as said at least one wiper;

locating a plurality of said wipers adjacent a respective plurality of said packers or plugs.

6. The method of claim 1, comprising:

delivering said at least one wiper with said at least one packer or plug.

7. The method of claim 1, comprising:

locating said wiper further uphole than at least one perforation in the borehole.

8. The method of claim 1, comprising:

providing multiple fins on said at least one wiper that are oriented in opposed directions.

9. The method of claim 1, comprising:

providing multiple fins on said at least one wiper that are in a parallel orientation.

10. The method of claim 1, comprising:

allowing some flow past said ring as said at least one wiper is flowed toward the surface with fluid from a formation.

11. The method of claim 1, comprising:

providing a passage through said mandrel;

making a cross-section of said ring a quadrilateral, circular or triangular.

12. The method of claim 11, comprising:

providing a wedge between a slip and a mandrel to lock said slip in a set position;

providing at least one rib on said wedge oriented away from the surface to prevent said slip from moving relatively to said mandrel in a downhole direction.

13. The method of claim 11, comprising:

providing a wedge between a slip and a mandrel to lock said slip in a set position;

providing at least one rib on said wedge oriented toward the surface to prevent said slip from moving relatively to said mandrel in an uphole direction.

14. The method of claim 1, comprising:

delivering said at least one wiper with coiled tubing, wireline or slickline.

15. The method of claim 1, comprising:

pumping said at least one wiper into position in the borehole.

16. The method of claim 1, comprising:

performing a treatment from the surface against at least one packer or plug.

17. The method of claim 16, comprising:

performing at least one of hydraulic fracturing, stimulation, tracer injection, cleaning, acidizing, steam injection, water flooding and cementing as said treatment.

18. The method of claim 1, comprising:

overcoming a retaining force by a sealing element on said at least one packer or plug after overcoming a grip of at least one slip with pressure differential in a direction toward the surface.

19. The method of claim 18, comprising:

locating said slip only downhole from the sealing element on said at least one packer or plug.

20. The method of claim 1, comprising:

flowing well fluids back and/or reducing pressure at the surface to create a pressure differential on said at least one packer or plug to move said at least one packer or plug to the surface for said capturing.

21. The method of claim 1, comprising:

avoiding milling out said at least one packer or plug due to said moving.

* * * * *